US006192961B1

(12) United States Patent
Martinez

(10) Patent No.: US 6,192,961 B1
(45) Date of Patent: Feb. 27, 2001

(54) SLIPCOVER FOR WINDOW BLIND

(76) Inventor: Vicki A. Cannarile Martinez, 2803 Hayden Way, Boise, ID (US) 83705

( * ) Notice: Subject to any disclaimer, the term of this patent is extended or adjusted under 35 U.S.C. 154(b) by 0 days.

(21) Appl. No.: 09/535,943

(22) Filed: Mar. 24, 2000

Related U.S. Application Data

(60) Provisional application No. 60/126,129, filed on Mar. 25, 1999.

(51) Int. Cl.[7] ..... A47H 1/00

(52) U.S. Cl. ..... 160/89; 160/178.1; 160/232; 160/236

(58) Field of Search ..... 160/89, 166.1, 160/176.1, 178.1, 232, 236, 237, 900

(56) References Cited

U.S. PATENT DOCUMENTS

| | | | | |
|---|---|---|---|---|
| 2,110,145 | * | 3/1938 | Loehr | 160/89 |
| 4,424,849 | * | 1/1984 | Robertson | 160/124 |
| 4,542,602 | | 9/1985 | Hoverson . | |
| 4,899,796 | | 2/1990 | Easley et al. . | |
| 4,911,220 | | 3/1990 | Hiller . | |
| 4,921,032 | | 5/1990 | May . | |
| 4,928,743 | | 5/1990 | Wojtysiak . | |
| 4,930,562 | * | 6/1990 | Goodman | 160/236 |
| 5,129,440 | | 7/1992 | Colson . | |
| 5,141,042 | * | 8/1992 | Schwaegerle | 160/236 |
| 5,271,447 | | 12/1993 | Aronovich . | |
| 5,303,760 | * | 4/1994 | Perez | 160/236 |
| 5,313,998 | | 5/1994 | Colson et al. . | |
| 5,358,024 | * | 10/1994 | Schwaegerle | 160/236 |
| 5,533,559 | | 7/1996 | Judkins . | |
| 5,564,900 | * | 10/1996 | McAuley | 416/62 |
| 5,566,735 | | 10/1996 | Jelic . | |
| 5,655,589 | | 8/1997 | Vartanian . | |
| 5,715,883 | * | 2/1998 | Keith | 160/168.1 V |
| 5,765,620 | | 6/1998 | Coleman . | |
| 5,775,399 | | 7/1998 | Shields, Jr. . | |
| 5,787,607 | * | 8/1998 | Schurch | 16/7.1 |
| 5,787,951 | | 8/1998 | Tonomura et al. . | |
| 5,988,254 | | 11/1999 | Hanright . | |

* cited by examiner

*Primary Examiner*—Bruce A. Lev
(74) *Attorney, Agent, or Firm*—Charlotte W. Catlett

(57) ABSTRACT

A removable slipcover for a window blind having an upper member, a bottom member, and a plurality of louvers, is provided. The slipcover includes a tubular body section having an interior and an exterior surface defined by a front and a back panel. The panels are along the top and sides such that the tubular body section has a length and width sufficient to cover the plurality of louvers on the window blind. The slipcover also includes a means a means for securing the tubular body section to the bottom member of the window blind and a means for permitting access to the mounting hardware of the upper member of the blind.

12 Claims, 12 Drawing Sheets

SLIPCOVER FOR WINDOW BLIND

CROSS-REFERENCES TO RELATED APPLICATIONS

This application is related to the provisional application Ser. No. 60/126,129, filed on Mar. 25, 1999, entitled Roman Shade Type Venetian Blind Slipcover.

STATEMENT REGARDING FEDERALLY SPONSORED RESEARCH OR DEVELOPMENT

Not Applicable

BACKGROUND OF THE INVENTION (1) Field of the Invention.

This invention relates to window coverings, and more particularly, to a removable slipcover for window blinds.

(2) Description of Related Art including information disclosed under 37 CFR 1.97 and 37 CFR 1.98.

The use of decorative blinds and shades to cover windows is well known. Examples of Roman style shades and Venetian, louvered, horizontal and vertical blinds and the like are disclosed in U.S. Pat. Nos. 5,988,254; 5,787,951; 5,765,620; 5,566,735; 5,533,559 5,313,998; 5,129,440; 4,928,743; 4,921,032; 4,899,796; and 4,542,602.

When a homeowner desires to change the aesthetic appearance of preexisting louvered blinds and shades, the choices are limited. The prior art means to change the appearance of louvered blinds includes the use of multiple decorative covers for each individual louver. Typically, these covers are reusable cloth or plastic sheaths and decals. Examples of these covers are disclosed in U.S. Pat. Nos. 5,775,399; 5,655,589; 5,271,447; and 4,911,220.

There are no known prior art teachings of a means for substantially changing the appearance of a louvered blind to a shade. In addition, the prior art requires the user to repeat the tedious process of changing individual slat covers and decals each time a new look, design, or seasonal decoration is desired. The present invention provides a means for rapidly and inexpensively changing the appearance of preexisting blinds without impeding the operation of the blind, and permits easy removal for hassle free seasonal decoration, cleaning and maintenance.

BRIEF SUMMARY OF THE INVENTION

The present invention is a removable slipcover for altering the appearance of preexisting window blinds and shades such as horizontal louvered blinds. The slipcover includes a tubular body section having front and back panels. The panels are joined together at the sides and top. In one embodiment, the panels may be detachably joined with a fastener such as velcro. The slipcover further includes a means for permitting access to the mounting hardware on the upper member of the window blind and a means for securing the tubular body section to the window blind, proximal to the blind's bottom member.

In one embodiment, the means for securing the tubular body proximal to the bottom of the blind includes an aperture in each panel and a retaining tab. When installed, the retaining tab is threaded through the apertures, wrapped around a bottom section of the blind and fastened. In one aspect, the retaining tab includes a button and buttonhole at distal ends. In another aspect, the retaining tab is a decorative cord.

In another embodiment, the means for securing the tubular body to the bottom of the blind includes a hidden retaining mechanism attached to the interior surface of the cover, proximal to the bottom of the front and back panels. In one aspect, the retaining mechanism is a plastic ring sewn on each panel, and a string threaded through each ring, tied around the bottom member of the blind.

In yet another embodiment of the invention, the means for permitting access to the mounting hardware of the upper member includes at least two apertures in the back panel of the tubular body, proximal to the top and sides. In still another embodiment, the top of the tubular body includes diagonal corners which form apertures proximal to the top of the body when the sides and top are joined.

In still another embodiment of the invention, the front panel includes at least one aperture for permitting access to an operating mechanism such as a draw cord for raising and lowering the blind and a tilt wand for opening and closing the louvers.

BRIEF DESCRIPTION OF THE SEVERAL VIEWS OF THE DRAWINGS

The invention will be better understood and its numerous objects and advantages will become more apparent to those skilled in the art by reference to the following drawings, in conjunction with the accompanying specification, in which.

DETAILED DESCRIPTION OF THE INVENTION

Figure 1:
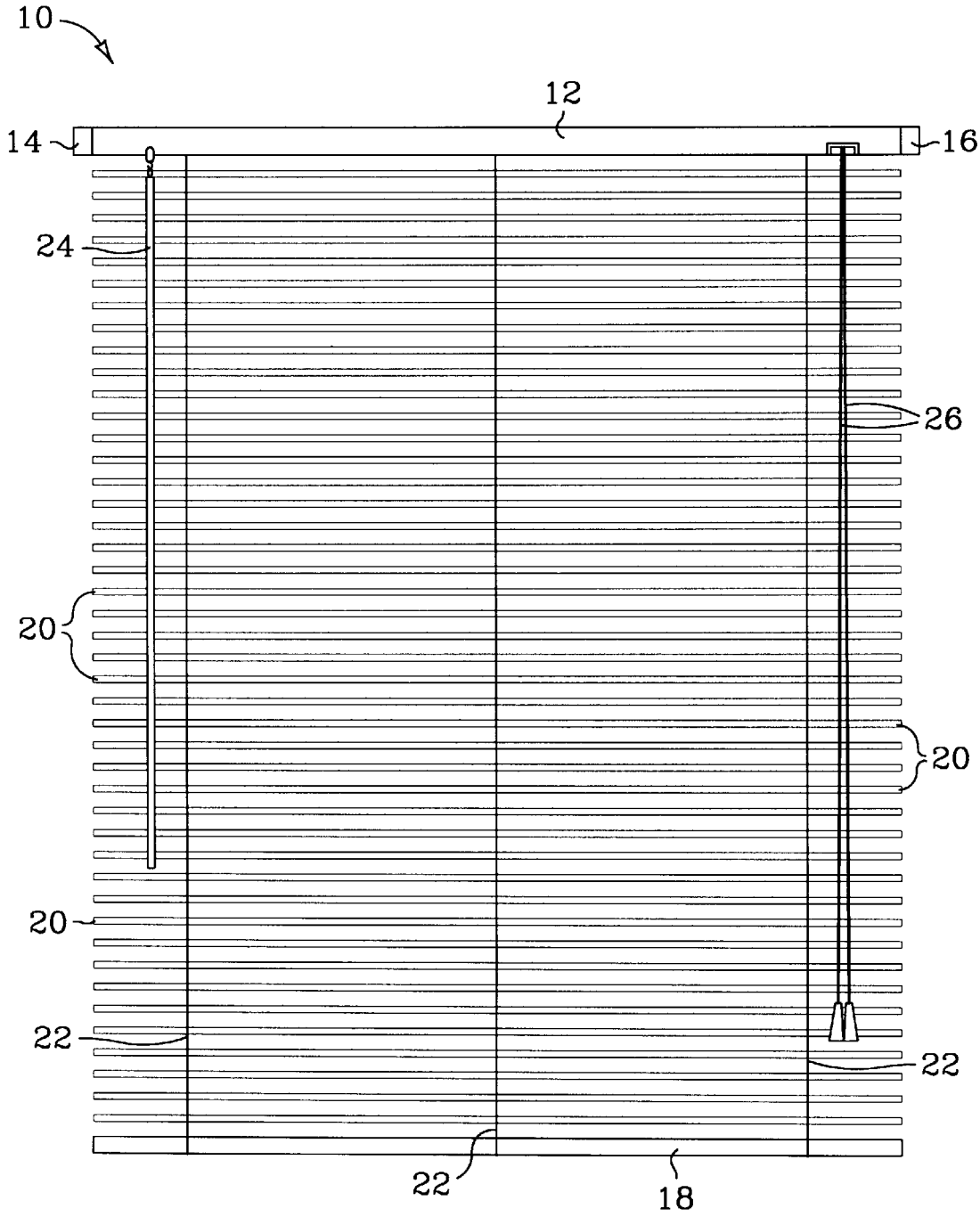
FIG. 1 is a front elevation view of a prior art window blind having a plurality of louvers suitable for use with the present invention.
Figure 2:
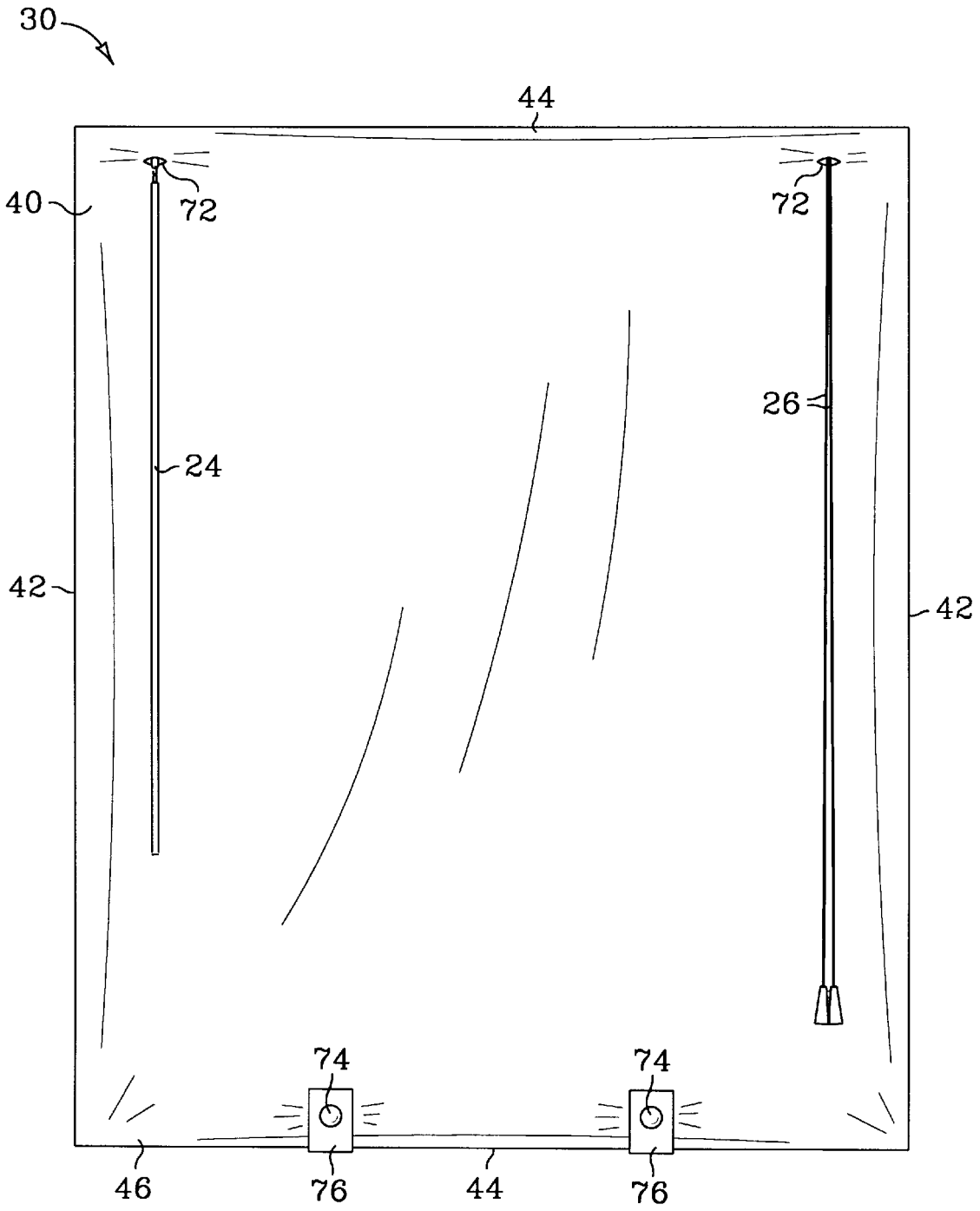
FIG. 2 is a front elevation view of an embodiment of the present invention installed on a window blind in the lowered position.
Figure 3:
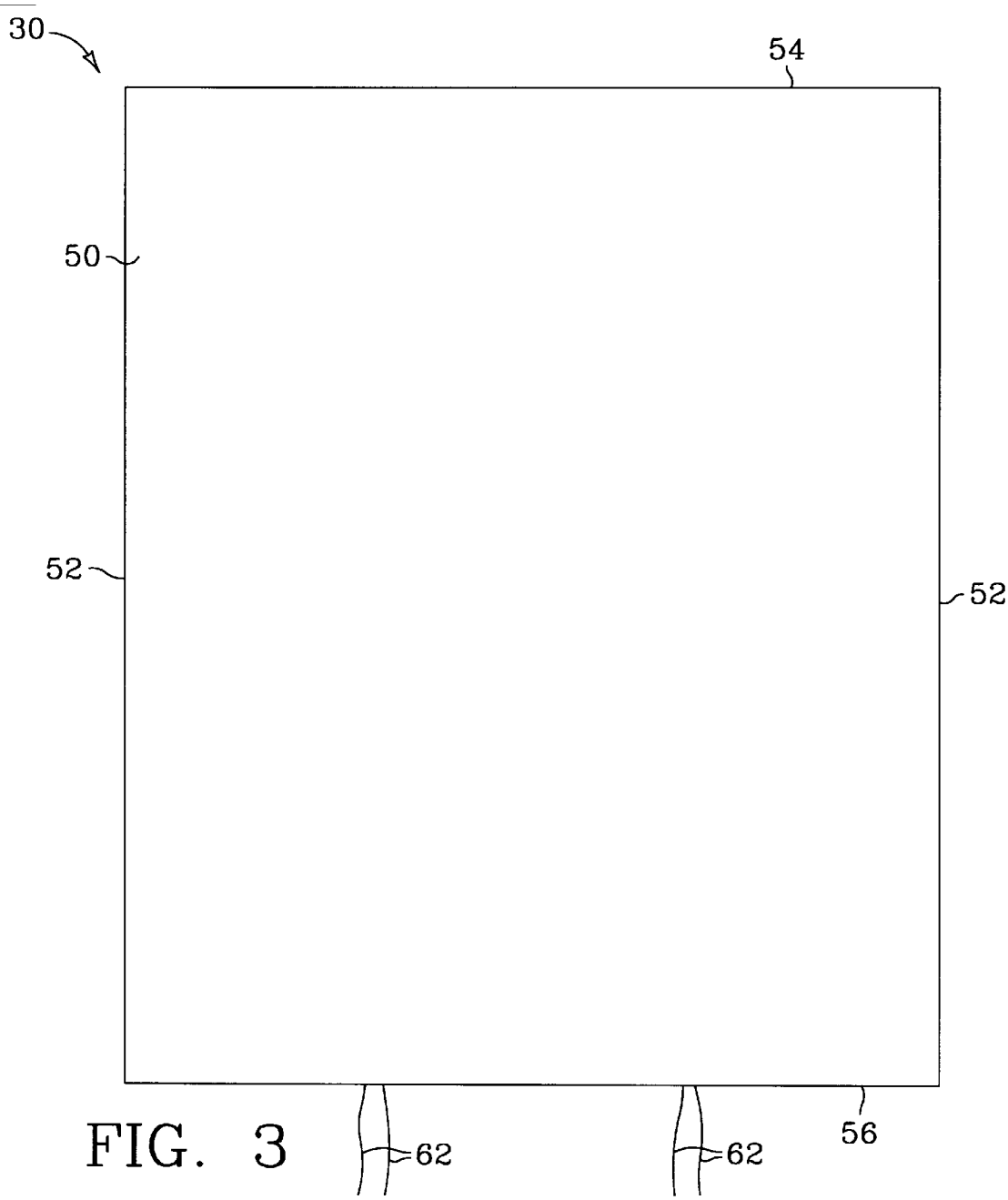
FIG. 3 is a rear elevation view of one embodiment the present invention shown in FIG. 2, depicting the back panel and a means for securing the cover to a window blind.
Figure 4:
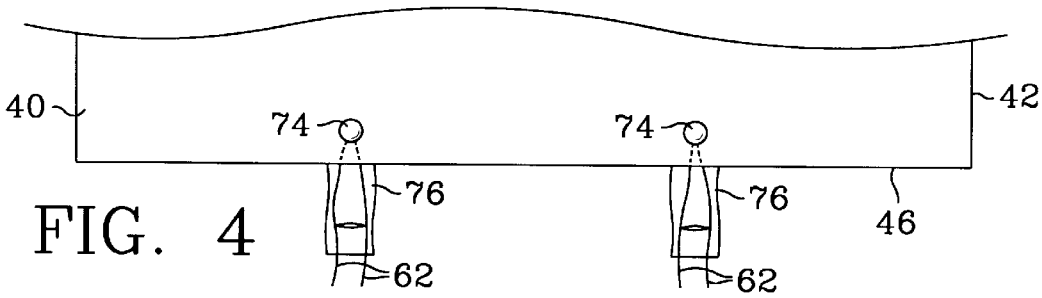
FIG. 4 is a partial front elevation view of the present invention shown in FIG. 2, depicting the lower edge of the front panel and an optional decorative tab.

The present invention is a slipcover for a louvered blind such as a horizontal or vertical louvered blind. Referring to FIGS. 2–6, the slipcover 30 of the present invention includes a front panel 40, a back panel 50, sides 42, 52, top 44, 54 and bottom 46, 56. When joined together at the sides 42, 52 and tops 44, 54, the front 40 and back 50 panels form a tubular body of sufficient length and width to cover a shade or the plurality of louvers of a window blind as shown in FIG. 1.

Figure 5:
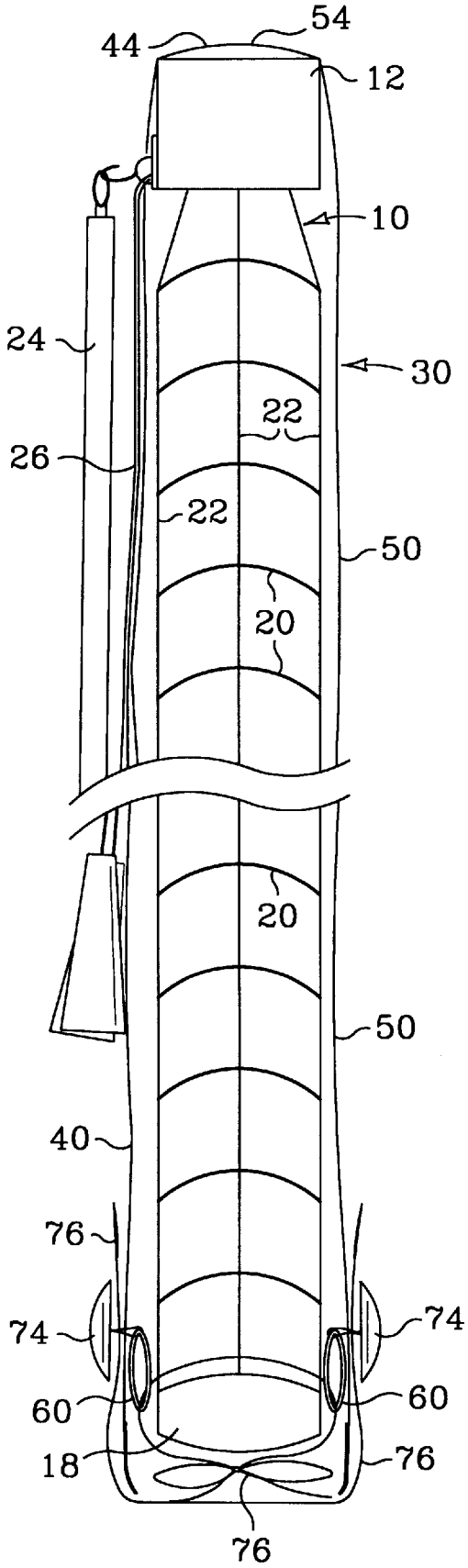
FIG. 5 is a partial sectional side view of present invention shown in FIG. 2, depicting the window blind in the lowered position.
Figure 6:
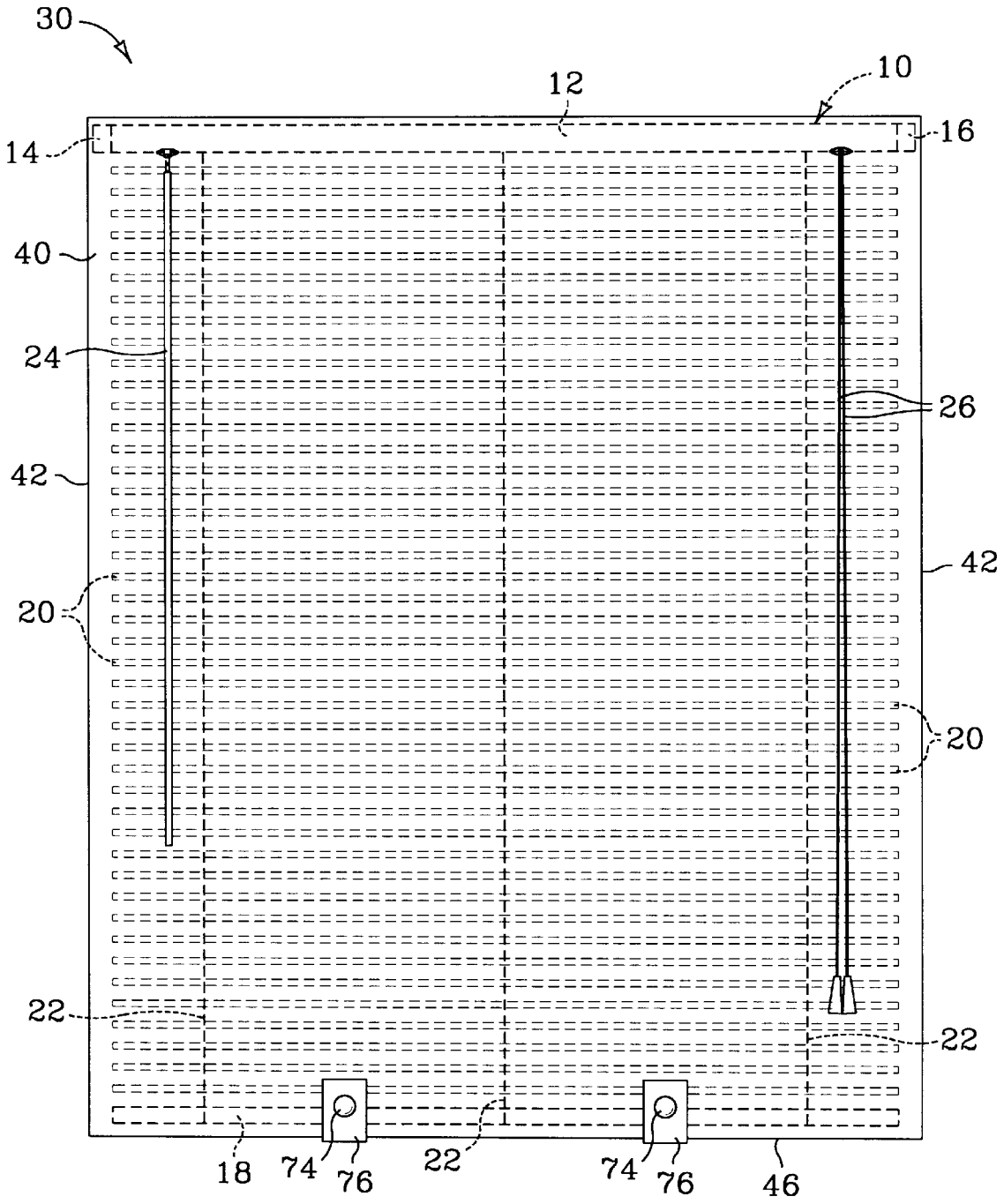
FIG. 6 is a front elevation view of the present invention shown in FIG. 2, depicting the hidden window blind of FIG. 1 in phantom.

Referring briefly to FIGS. 1 and 6, louvered mini-blind 10 includes an upper member 12, having mounting ends 14, 16, a lower member 18, a plurality of louvers 20, adjustment strings 22, a tilt wand 24 and a draw cord 26. Referring back to FIGS. 2–6, slipcover 30 further includes a means for securing the tubular body section to the lower member 18 of the window blind 10 and a means for permitting access to the upper member 12 to facilitate mounting of the blind 10. Optionally, front panel 40 of slipcover 30 may include apertures 72 for permitting access to the operating means of the blind such as tilt wand 24 and draw cord 26.

Figure 7:
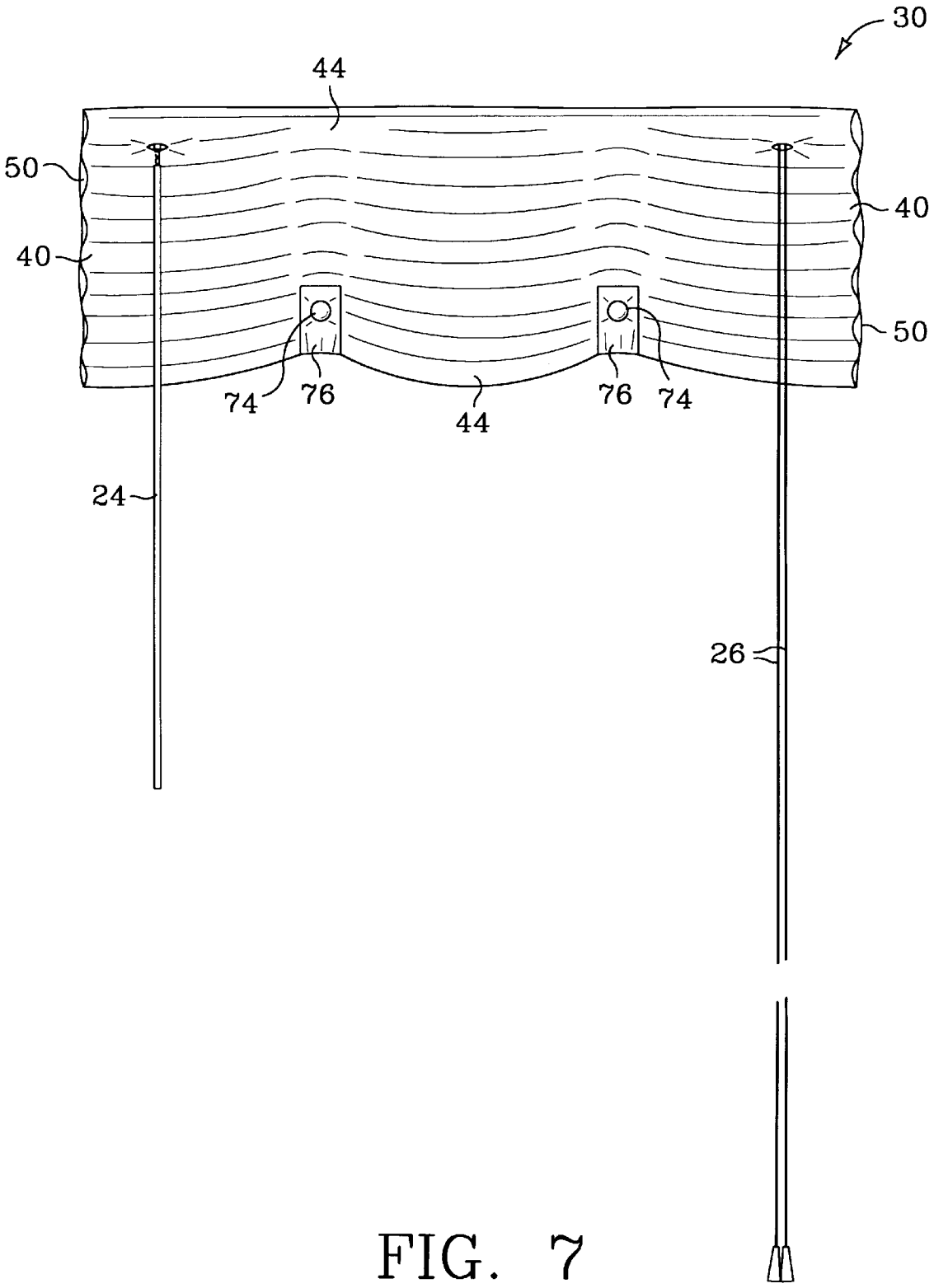
FIG. 7 is a front elevation view of the present invention shown in FIG. 2, depicting the window blind in the raised position.
Figure 8:
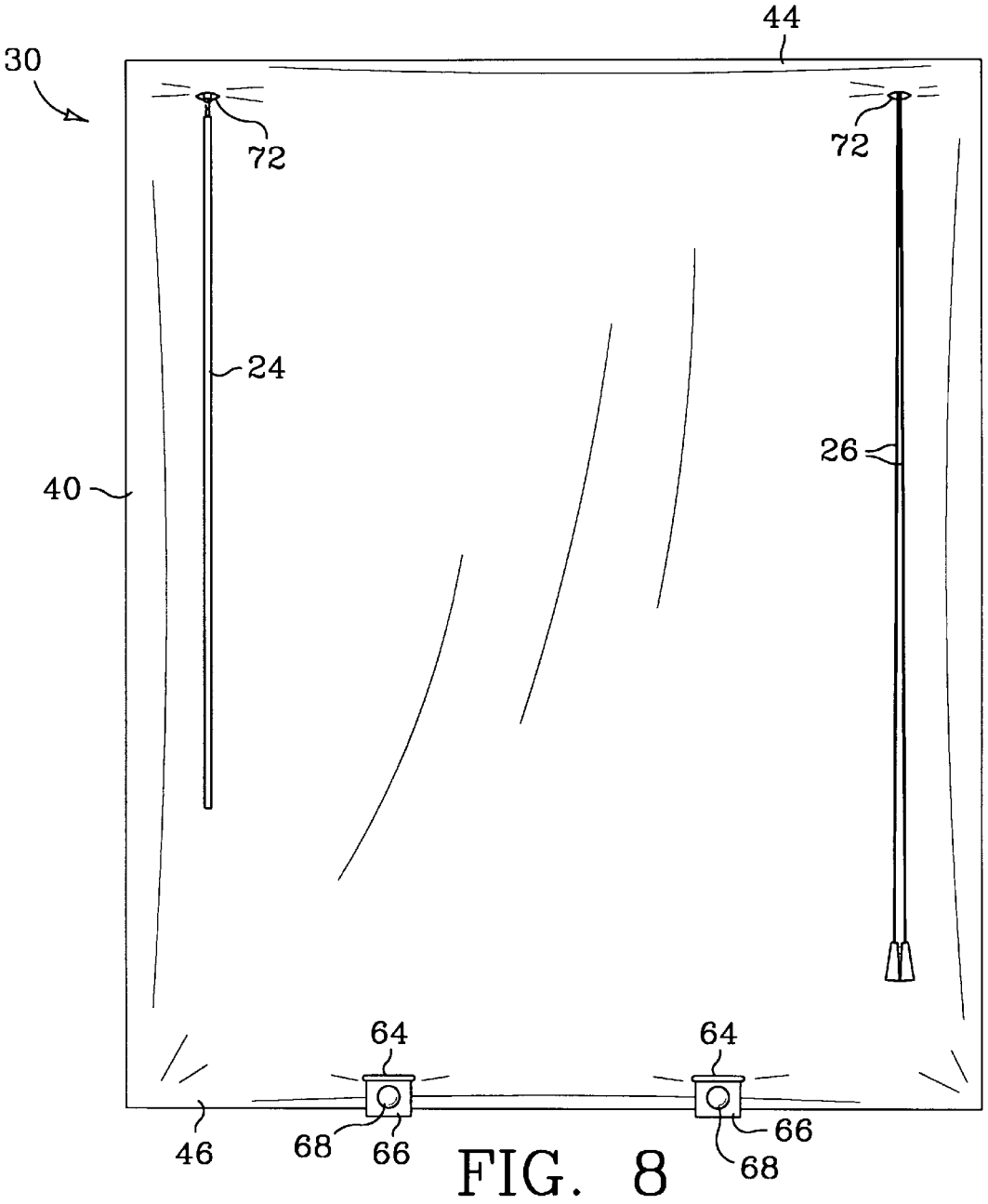
FIG. 8 is a front elevation view of another embodiment the present invention depicting an alternative means for securing the cover to the window blind.
Figure 9:
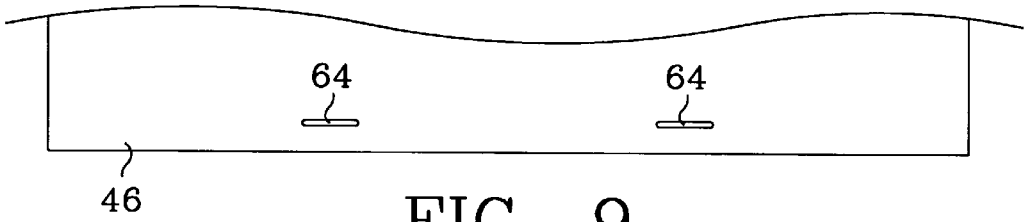
FIG. 9 is a partial front elevation view of the present invention shown in FIG. 8, depicting the securing apertures.
Figure 10:
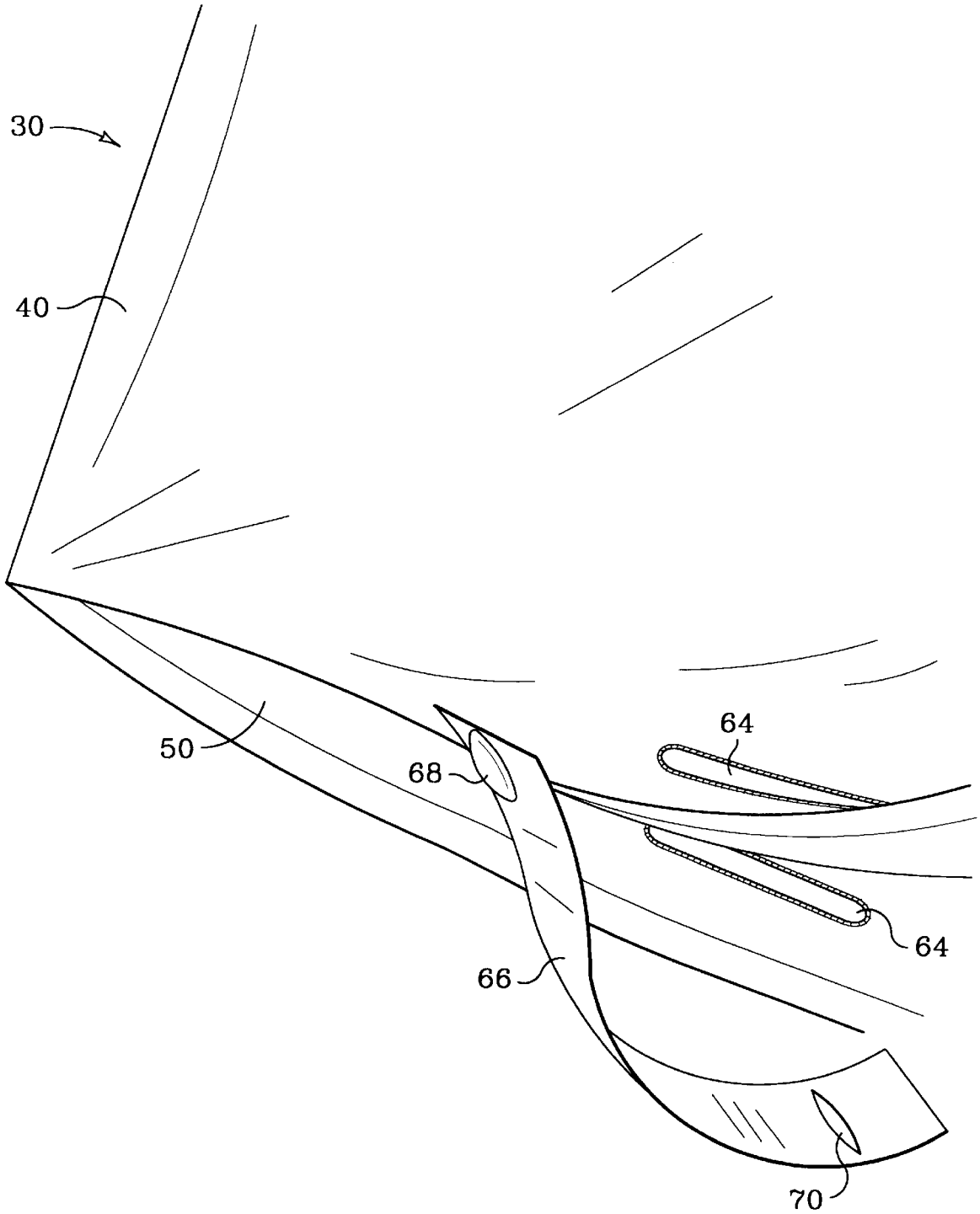
FIG. 10 is a partial perspective of the embodiment shown in FIG. 8, depicting an unattached strap and aperture securing means.
Figure 14:
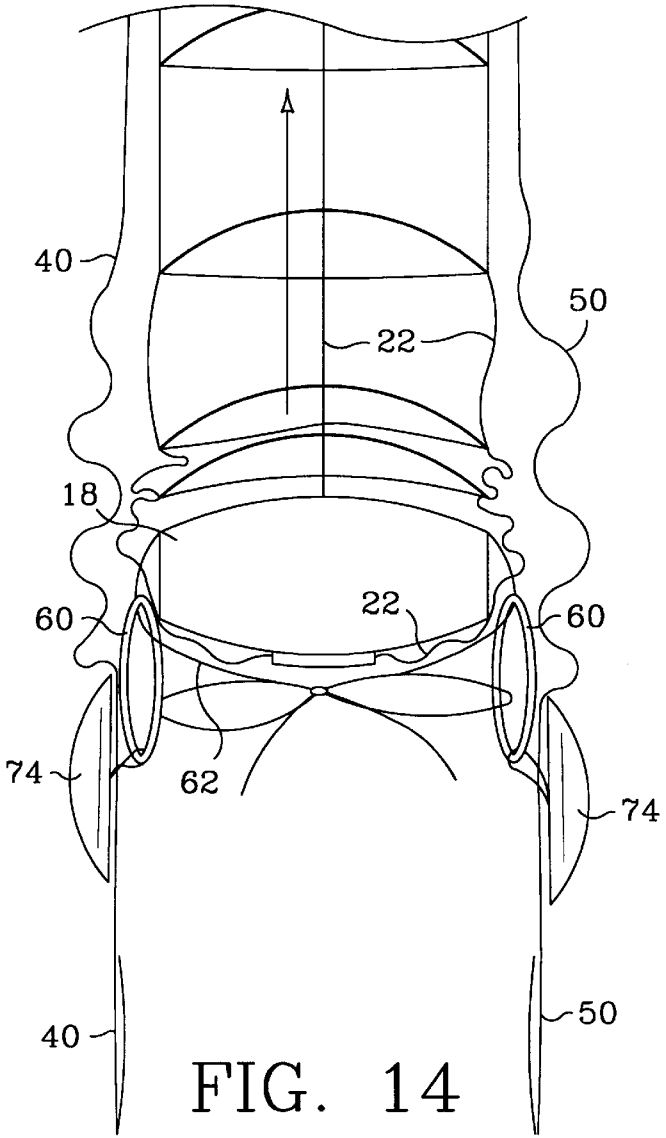
FIG. 14 is a partial sectional side view of the present invention shown in FIG. 13, depicting the window blind in the partially raised position.
Figure 13:
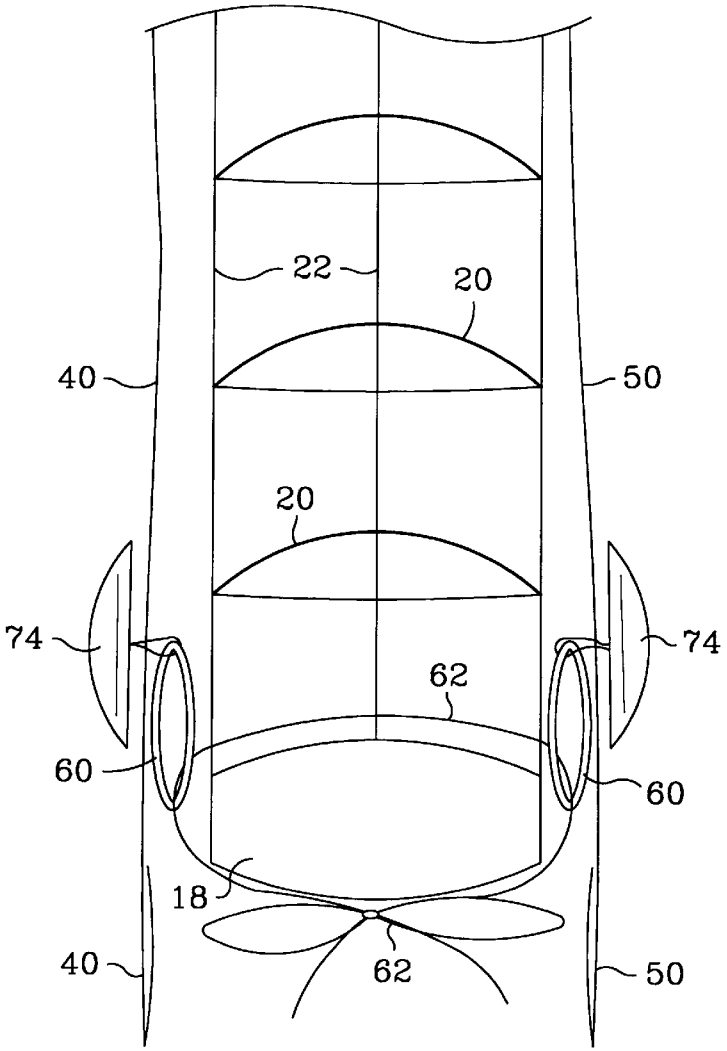
FIG. 13 is a partial sectional side view of the present invention shown in FIG. 2, installed on a window blind in the lowered position.

In one embodiment, the means for securing the tubular body section to the lower member 18 includes retaining rings 60 and strings 62. As shown in FIGS. 5, 13, and 14, retaining rings 60 are attached to the interior surfaces of the front 30 and back 40 panels. Retaining string 62 is then threaded through the rings and secured around the bottom member. Decorative buttons 74, tabs 76, or the like, may be added to the outer surface of the front and back panels to change the aesthetic appearance of the slipcover, as well as provide a traditional sewing anchor for the internally mounted retaining rings. As shown in FIGS. 7, 13, and 14, draw cord 26 and tilt wand 24 are freely operational to raise and lower the blind 10 and slipcover 20 once cover 10 is secured to bottom member 18 using retaining rings 60 and strings 62.

Figure 12:
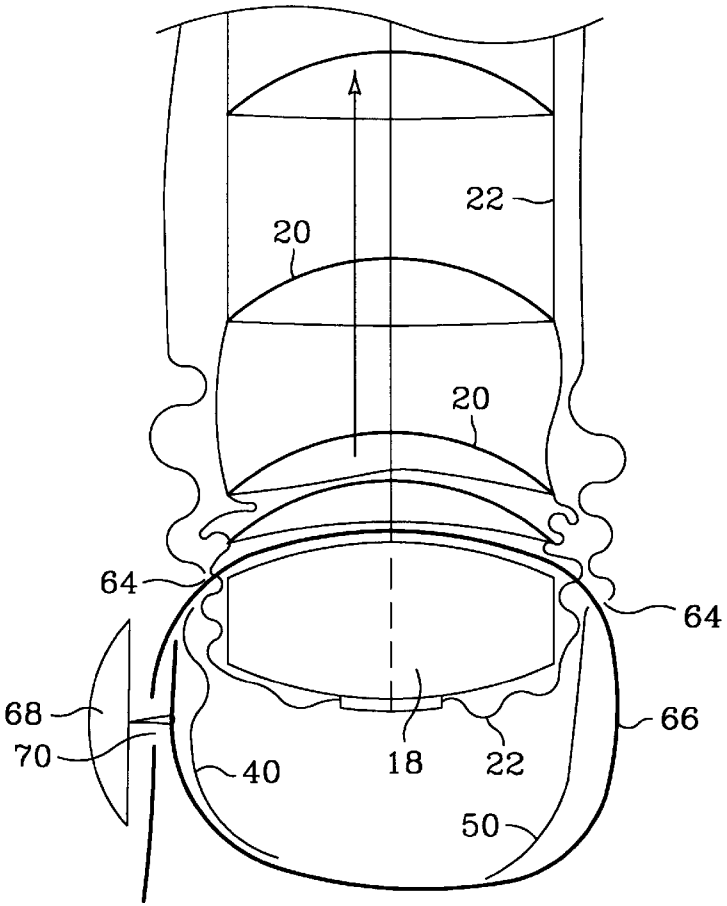
FIG. 12 is a partial sectional side view of the present invention shown in FIG. 8, depicting the window blind in the partially raised position.
Figure 11:
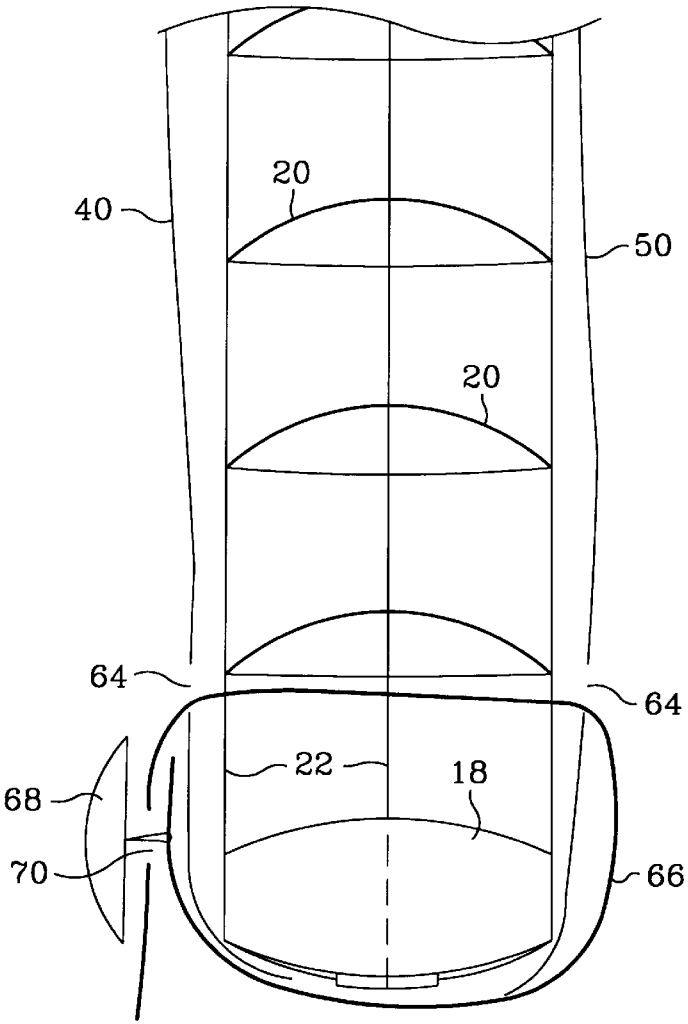
FIG. 11 is a partial sectional side view of the present invention shown in FIG. 8, depicting the window blind in the lowered position.

In an alternative embodiment, as shown in FIGS. 8–12, the means for securing the tubular body section to the lower member 18 includes apertures 64 in the front and back panels 40, 50 and retaining straps 66. Specifically, the apertures are proximal to the bottom of the panels 40, 50, such that retaining straps 66 may be threaded through the apertures 64, around bottom member 18 and secured using a conventional cord, tie, or fastener such as the button 68 and buttonhole 70 combination shown on strap 66. As shown in FIGS. 11 and 12, the blind remains fully operational and may be raised and lowered, unencumbered by the attached slipcover.

Figure 15:
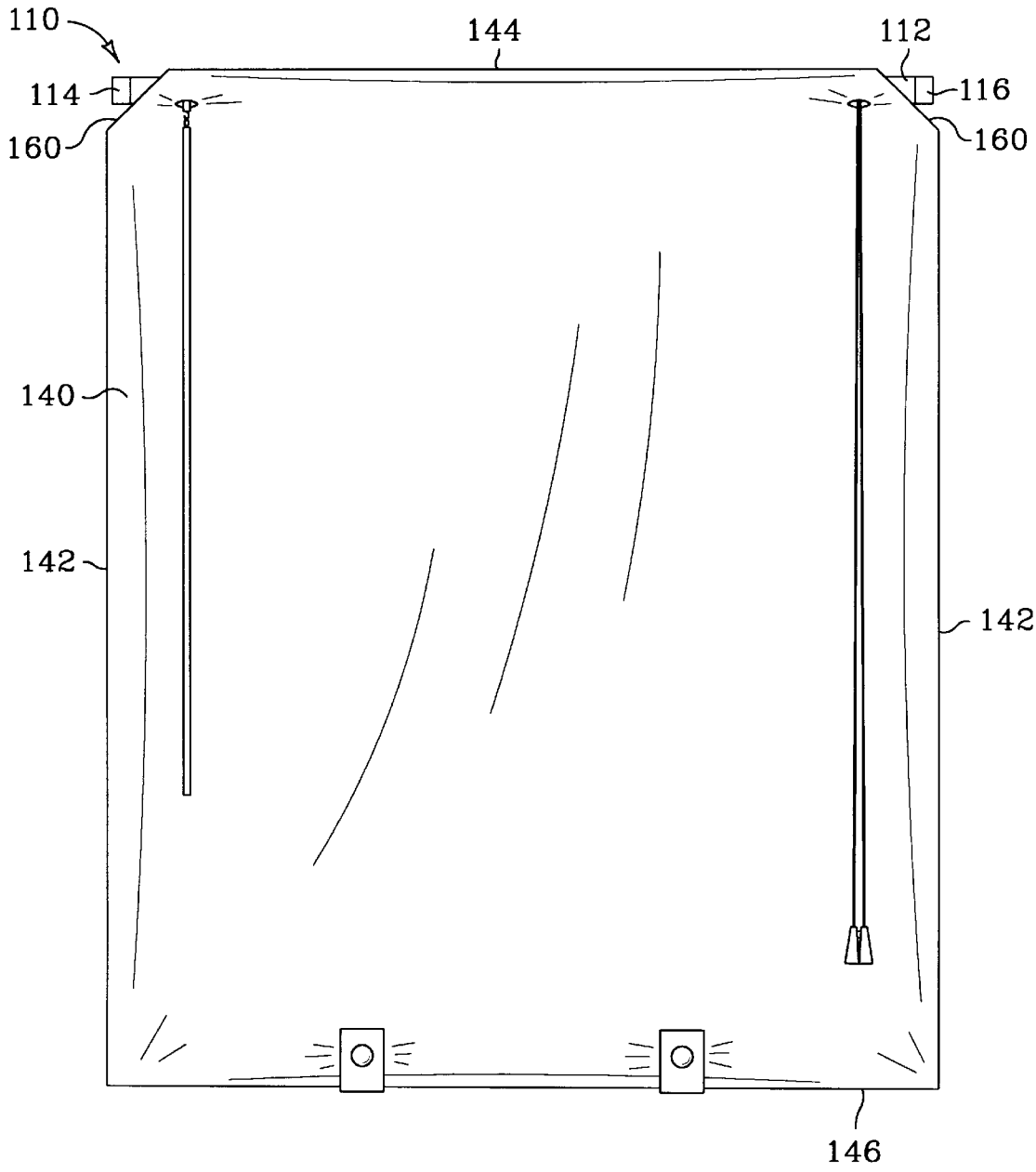
FIG. 15 is a front elevation view of one embodiment of the present invention, installed on a window blind designed for mounting within the window frame.
Figure 16:
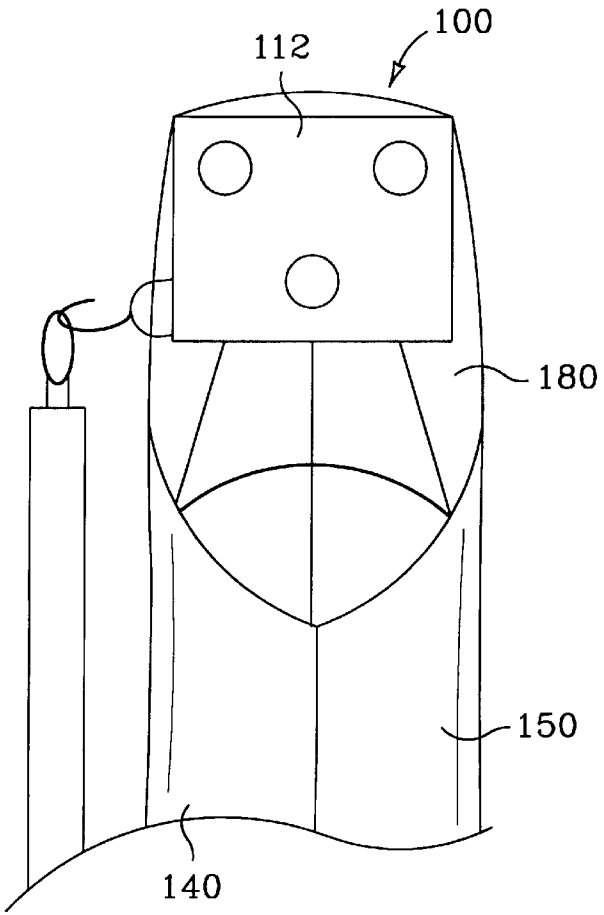
FIG. 16 is a partial side view of the present invention shown in FIG. 15.

Referring to FIGS. 15–16, means for permitting access through slipcover 100 to the upper member 112 for mounting the blind 110 are provided. As shown in FIGS. 15 and 16, front and back panels 140, 150 include optional diagonal corners 160, which form apertures 180 when sides 142, 152 and tops 144, 154 are joined. These apertures permit access to standard mounting caps 114, 116 for mounting the blind 110 within a window casing, frame or cavity.

Figure 17:
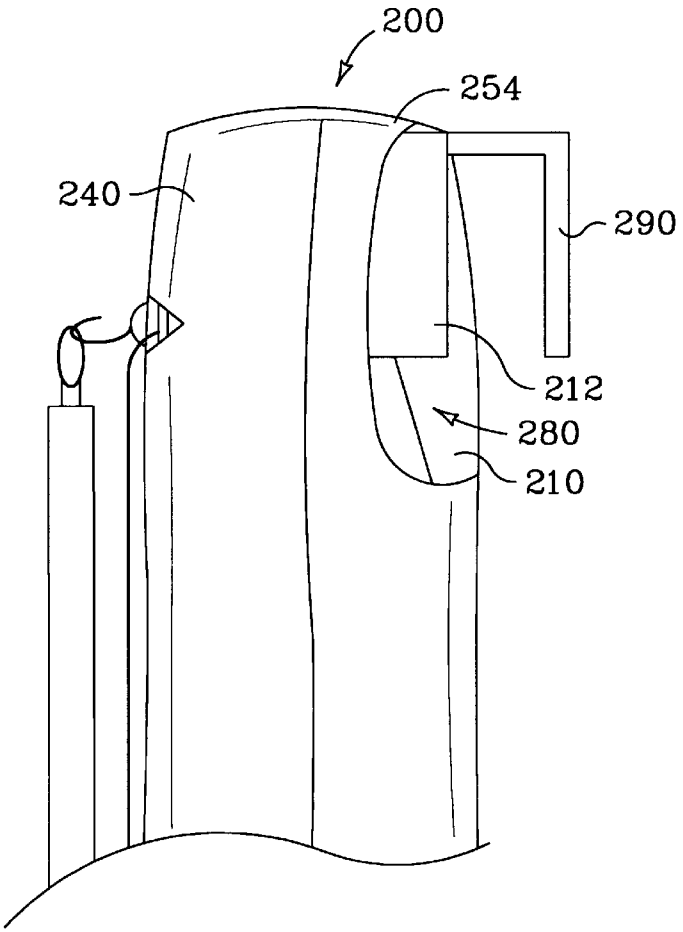
FIG. 17 is partial side view of the present invention configured for installation on a wall mount window blind.

With reference to FIG. 17, alternative slipcover 200, including panels 240, 250, is provided having apertures 280 proximal to top 254 of back panel 250. This style of slipcover 200 permits access to standard mounting hardware 290 attached to upper member 212 of blind 210 traditionally used for wall mounted blinds.

The methods of operation of the slipcover in combination with the blind will now be described. First, the blind is removed from its wall or window casing mount. Next, the tubular body of slip cover 20 is placed over blind 10 , such that tops 52, 42, are adjacent to upper member 44 and lower edges 46, 56, are proximal to bottom member 18. Next, draw cords 26 are pulled through aperture 72 and tilt wand 24 is reattached through aperture 72. In the next step, the slipcover 10 is secured to the bottom member (or lower louvers) of the blind. Finally, the combination cover and blind are remounted on the existing hardware on the wall or window casing.

It will be understood and appreciated by one skilled in the art that most flexible materials are suitable for construction of the slipcover of the invention, including light filtering and opaque materials to provide greater light control. In addition, the panels 40, 50 may be detachably joined using traditional fasteners such as Velcro, zippers, or hooks and eyes. The slipcover may be installed in this embodiment, without removing the blind or shade from its preexisting mount. Valances, curtains, and other traditional window decorations may also be used in combination with the present invention.

It will be understood and appreciated by those skilled in the art that the present invention may be changed or modified for use on other window coverings such as vertical louvered blinds and single panel shades without departing from the spirit and scope of the invention as defined in the following claims.

What is claimed is:

1. A removable slipcover in combination with a window blind having an upper member, a bottom member, and a plurality of louvers, said slipcover comprising:

a tubular body section having an interior and an exterior surface defined by a front and a back panel, each said panel having a top, bottom, first and second sides, wherein said panels are joined along said top and said first and second sides and said tubular body section has a length and width sufficient to removably encase the plurality of louvers therein;

a means for permitting access to the upper member; and a means for securing the tubular body section to the bottom member of the window blind.

2. The slipcover of claim 1, wherein said front and back panels are detachably joined along said tops.

3. The slipcover of claim 1, wherein said front and back panels are detachably joined along said sides.

4. The slip cover of claim 1, wherein the means for securing the tubular body section to the bottom member of the window blind includes an aperture proximal to the bottom of the front panel, an aperture proximal to the bottom of the back panel and a retaining tab.

5. The slip cover of claim 1, wherein the means for securing the tubular body section to the bottom member of the window blind includes at least one retaining mechanism attached to the interior surface of the tubular body section, proximal to the bottom of the front and back panels.

6. The slipcover of claim 5, wherein the retaining mechanism includes a plastic ring and a string of sufficient length to thread through the ring and around the bottom member of the blind.

7. The slipcover of claim 1, wherein the means for permitting access to the upper member includes at least two apertures in the back panel of the tubular body, proximal to the top and first and second sides.

8. The slipcover of claim 1, wherein the means for permitting access to the upper member includes an aperture at each side, proximal to the top of each panel.

9. The slipcover of claim 8, wherein each said front and back panel includes two diagonal comers proximal to each top.

10. The slipcover of claim 1, wherein said front panel has at least one aperture proximal to said top for permitting access to an operating means for changing the position of the blind.

11. The slipcover of claim 1, wherein said tubular body is constructed of a light filtering material.

12. The slipcover of claim 1, wherein said tubular body is constructed of an opaque material.

* * * * *